US006023893A

United States Patent [19]

Tanaka

[11] Patent Number: 6,023,893

[45] Date of Patent: Feb. 15, 2000

[54] MOVABLE PARTITION WALL

[75] Inventor: Shigekazu Tanaka, Kyoto, Japan

[73] Assignee: Kokuyo Co., Ltd., Japan

[21] Appl. No.: 08/973,586

[22] PCT Filed: Dec. 5, 1996

[86] PCT No.: PCT/JP96/03567

§ 371 Date: Dec. 5, 1997

§ 102(e) Date: Dec. 5, 1997

[87] PCT Pub. No.: WO97/43495

PCT Pub. Date: Nov. 20, 1997

[30] Foreign Application Priority Data

May 10, 1996 [JP] Japan ..... 8-116171

[51] Int. Cl.[7] ..... E04F 19/06

[52] U.S. Cl. ..... 52/220.7; 52/238.1

[58] Field of Search ..... 52/220.7, 220.1, 52/238.1

[56] References Cited

U.S. PATENT DOCUMENTS 4,631,881 12/1986 Charman ..... 52/220.7

FOREIGN PATENT DOCUMENTS 61-13413 8/1986 Japan .
3-228946 10/1991 Japan .
6-81425 3/1994 Japan .
8-239947 9/1996 Japan .

*Primary Examiner*—Beth Aubrey
*Attorney, Agent, or Firm*—Banner & Witcoff, Ltd.

[57] ABSTRACT

A movable partition wall for simplifying interior wiring work. The movable partition wall includes a structural frame body having front and rear sides and at least one panel mounting surface including recessed portions. A panel is removably attached to the panel mounting surface and forms wiring spaces and wiring holes within the wall. The wiring holes communicate with the wiring spaces so that electrical cords can be passed from one wiring space to another wiring space. A plurality of the wiring holes also communicate with an area outside of the structural frame body so that cords can be easily introduced into the wall.

21 Claims, 11 Drawing Sheets

MOVABLE PARTITION WALL

TECHNICAL FIELD

This invention relates to a movable partition wall to be suitably used in an office room and the like.

TECHNICAL BACKGROUND

In recent office rooms and the like, there is increasing need to store a rapidly increasing number of cords, such as electric cords of electric office appliances and telephone wires, in order not to obstruct usual office work and to arrange them in harmony with the interior appearance of the room. For this purpose, movable partition walls which have wiring spaces in the inside are being developed. A movable partition wall is usually placed near an individual desk to store cords in its inside, so that it is possible to minimize the number of cords placed on the floor or wall.

Among known movable partition walls, for example as shown in FIG. 11, there is one having a wiring space 4 in the inside defined by a structural frame body 2 having side end surfaces 1*a* and panels 3 which are removably attached to the front and rear panel mounting surfaces 2*a* of the structural frame body 2, with wiring holes 6 formed in the center of the side frame components 21 which form the side end surfaces 1*a* of the structural frame body 2 so as to communicate the side end surfaces 1*a* and the wiring space 4. In this known type, wiring holes 7 are formed in the center of a lower frame component 23 which forms the lower end surface 1*c* of the structural frame body 2 so as to communicate the lower end surface 1*c* and the wiring space 4, and wiring holes 8 are also formed in the center of a middle frame component 24 which is horizontally provided in the wiring space 4 to connect the right and left side frame components 21 and partition the wiring space 4 so as to communicate the upper and lower wiring spaces 4. In this type of movable partition walls, it is possible to arrange cords 5 for proper wiring by removing the panel 3 from the panel mounting surface 2*a* and putting the cords 5 in the wiring spaces 4 through the wiring holes 6, 7 and 8.

In the conventional type of movable partition wall, there is a problem that wiring work is complicated. In particular, the cord 5 has to be put into the wiring hole 6 from its tip in wiring work, and such work is complicated because the tip is usually connected to a connecting component such as a plug which is wider than the diameter of the cord 5. And the diameter of the wiring hole 6 must not only be excessively large to permit the connecting component to pass through, but also be further enlarged when several cords 5 are to be provided. Furthermore, since wiring work requires the cord 5 to be once removed from the appliance to which it is connected, it is not possible to keep connection of a communication cord and the like which must always keep connection. The same is true with the wiring holes 7 and 8.

DISCLOSURE OF THE INVENTION

In order to solve the above problems, in this invention, a recessed portion is formed in a panel mounting surface of a structural frame body, and a wiring hole is formed by a panel removably attached to the panel mounting surface and the recessed portion. To put a cord in a wiring space formed in the inside, the panel is removed from the panel mounting surface to put the cord into the recessed portion in the panel mounting surface, after which the panel is attached to the panel mounting surface. Therefore, the invention can make wiring work easy and the size of the wiring hole suitable for the dimension of the cord.

The movable partition wall of the invention is provided with a structural frame body having a panel mounting surface formed only at the front or at both the front and rear sides thereof, a panel attached removably to the panel mounting surface of the structural frame body, a wiring space formed in its inside, a recessed portion formed in the panel mounting surface, and a wiring hole formed by the recessed portion and the panel for communication between the wiring space and the outside of the structural frame body.

For formation of such a wiring hole in a side end surface of the movable partition wall, a recessed portion may be formed in the panel mounting surface of a side frame component which forms a side end surface of the structural frame body, so that the recessed portion may form a wiring hole which communicates the side end surface and the wiring space.

For formation of such a wiring hole in an upper end surface of the movable partition wall, a recessed portion may be formed in the panel mounting surface of an upper frame component which forms the upper end surface of the structural frame body, so that the recessed portion may form a wiring hole which communicates the upper end surface and the wiring space.

For formation of such a wiring hole in a lower end surface of the movable partition wall, a recessed portion may be formed in the panel mounting surface of a lower frame component which forms a lower end surface of the structural frame body, so that the recessed portion may form a wiring hole which communicates the lower end surface and the wiring space.

For communication between each of the partitioned wiring spaces and the others, it is advantageous that a recessed portion is formed in the panel mounting surface of a middle frame component arranged horizontally to connect the right and left side frame components and to partition the wiring space, so that the recessed portion forms a wiring hole which communicates the wiring spaces above and below the middle frame component.

For prevention of damage to the cords by friction of the cords with a surface of the recessed portion or other causes, it is advantageous that the surface of the recessed portion is covered by a cap, so that the wiring hole is formed by the cap and the panel.

Furthermore, for keeping the cords in the wiring hole before mounting the panel to the panel mounting surface, it is preferable that a cover is removably fixed to the cap so that the cover and the panel mounting surface are approximately at the same plane, so that the wiring hole is formed between the cover and the cap.

By the above-mentioned arrangement of the invention, effects described below are expected:

Since the wiring hole is formed by the recessed portion formed in the panel mounting surface and the panel, it is not necessary to put the cord from its tip into the wiring hole so that a variety of cords can be easily placed through the wiring hole, and it is possible to keep connection of the cord to the appliance during the wiring work. Furthermore, because it is possible to do the wiring work regardless of the construction of a connecting component provided at the tip of the cord, the dimension of the wiring hole can be reduced to a minimum in accordance with only the diameter of the cord.

Since the recessed portion is formed in each of the side, upper and lower frame components, the wiring hole can be easily formed in each of the side, upper and lower end surfaces of the movable partition wall by only simple machining.

Since the recessed portion is formed in the middle frame component, the partitioned wiring spaces can easily be made to communicate with each other by only simple machining.

Since the surface of the recessed portion is covered by the cap, damage to the cords by friction of the cords with the surface of the recessed portion and other causes can be prevented without fail.

Furthermore, since the cover is removably fixed to the cap so that the cover and the panel mounting surface are approximately at the same plane, and the wiring hole is formed between the cover and the cap, the wiring work becomes even easier because the cords can be kept in the wiring hole, and it is possible to make the effective dimension of the wiring hole larger by removing the cover from the cap if the cover is not necessary.

BEST MODES OF EMBODYING THE INVENTION

Figure 1:
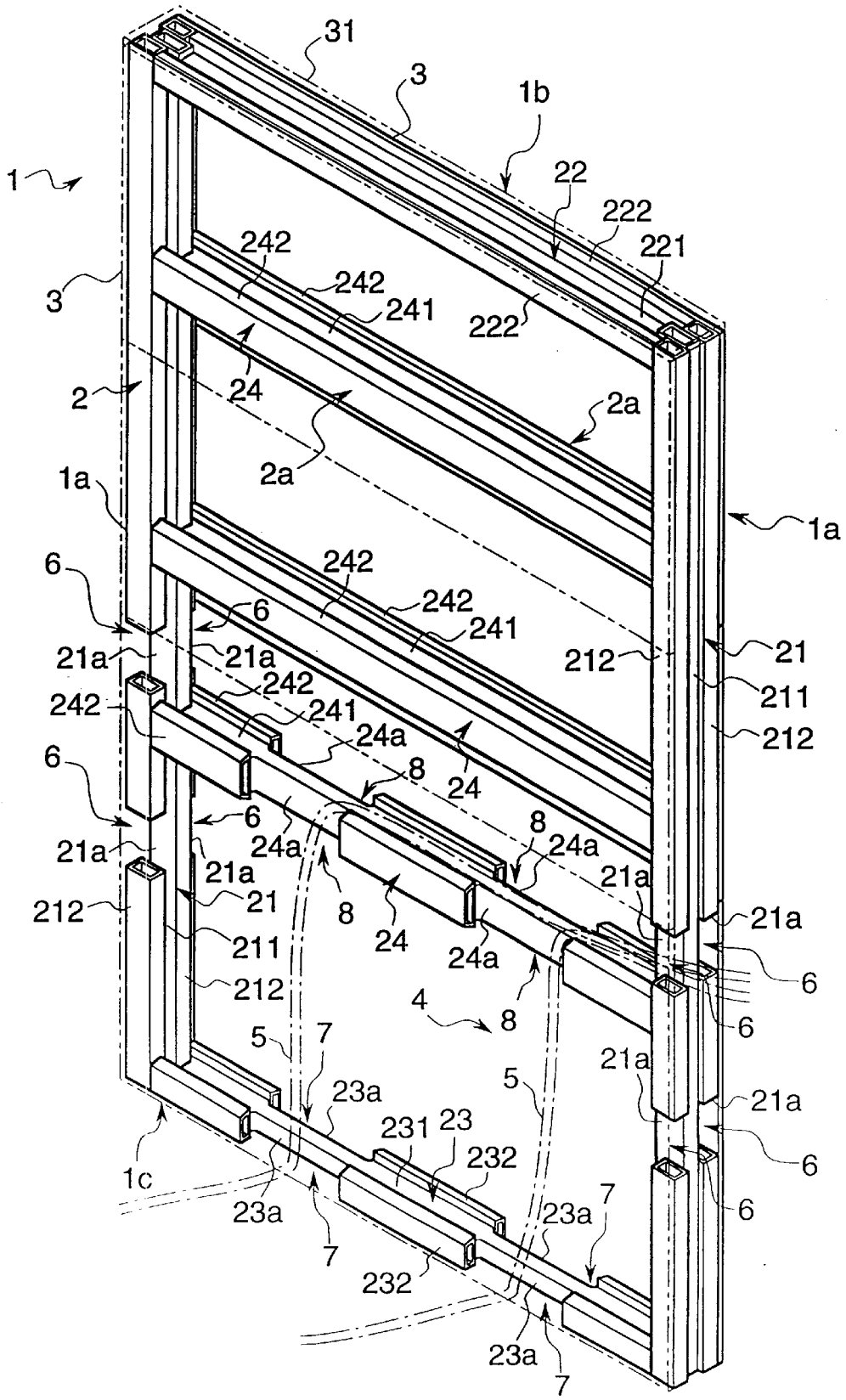
FIG. 1 is a perspective view showing one embodiment of the invention in which the front panel is removed.
Figure 2:
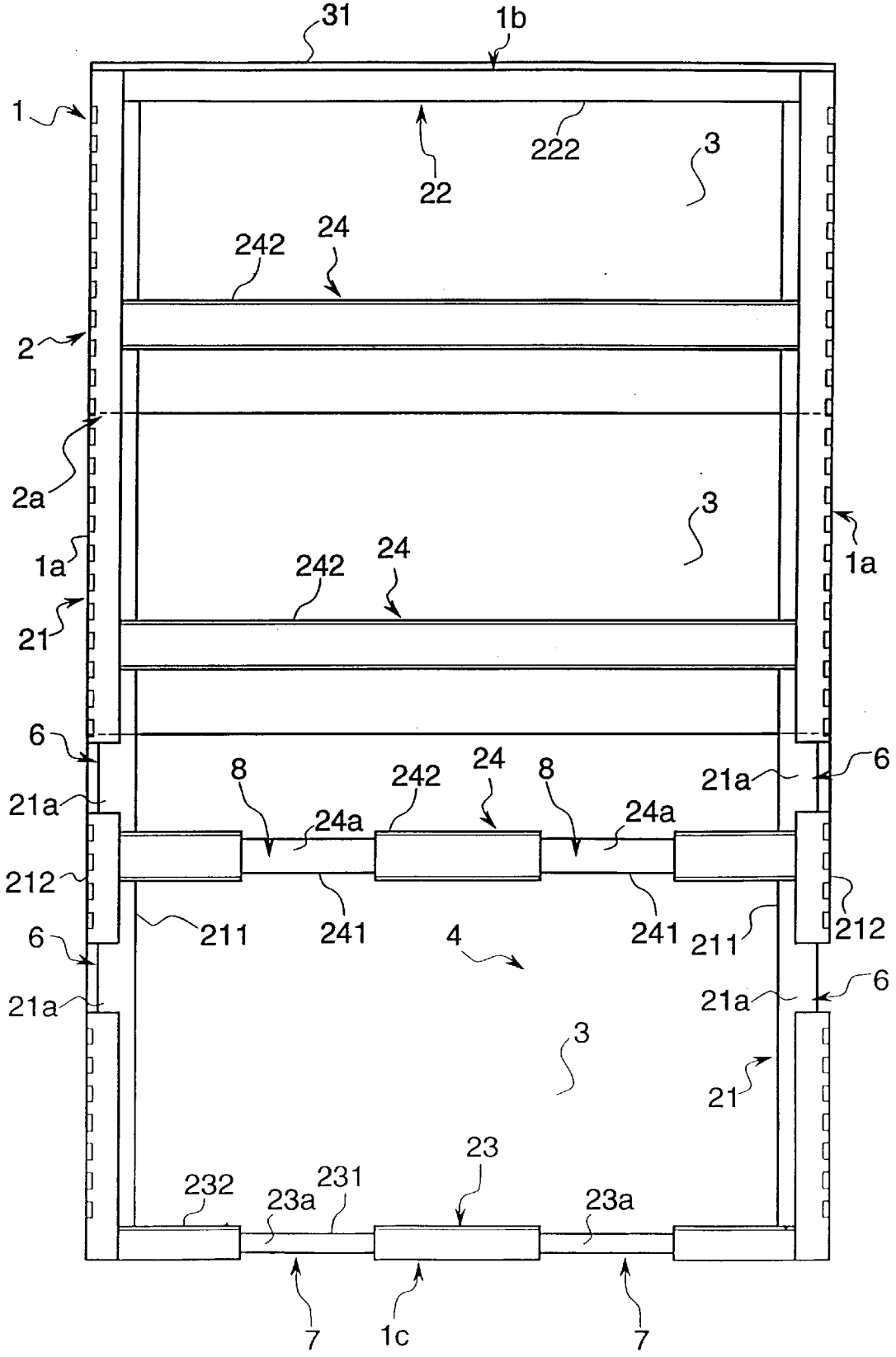
FIG. 2 is a front view showing the embodiment in which the front panel is removed.
Figure 3:
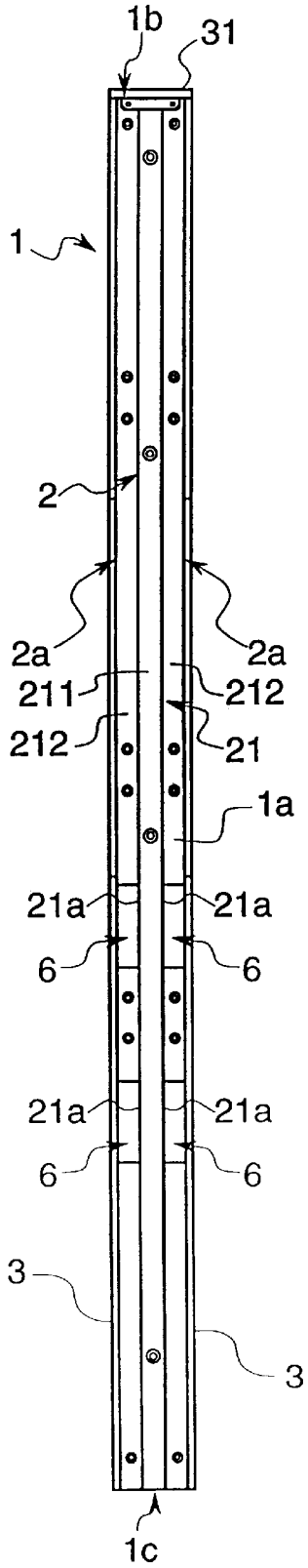
FIG. 3 is a side view showing the embodiment.
Figure 4:
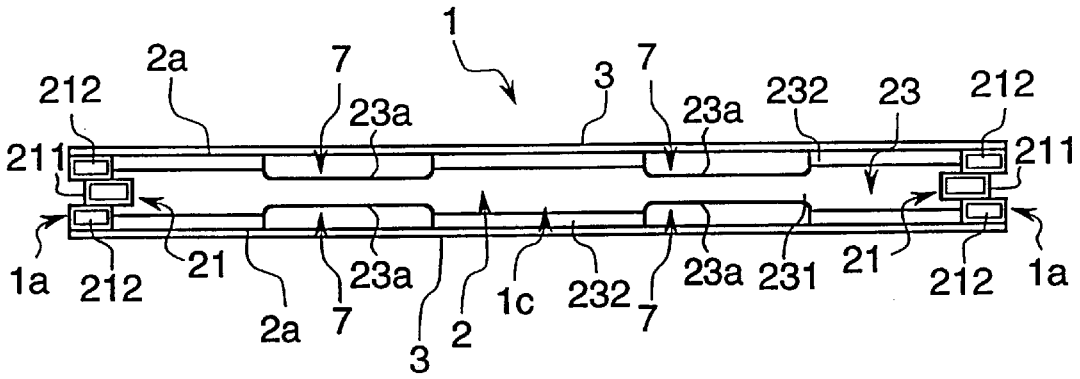
FIG. 4 is a bottom view showing the embodiment.

One embodiment of the invention will be described with reference to FIGS. 1 through 5, As shown in FIGS. 1 through 4, the movable partition wall 1 in the embodiment is formed with a wiring space 4 in the inside which is defined by a structural frame body 2 which forms the side, upper and lower end surfaces 1*a,* 1*b* and 1*c,* and panels 3 which are removably attached onto the front and rear panel mounting surfaces 2*a* of the structural frame body 2, so that the wiring space 4 can store the cords 5.

The structural frame body 2 is a rectangular one made of metal frame components, and composed of right and left side frame components 21 which form the side end surfaces 1*a* of the structural frame body 2, and the inner surfaces of which are fixed by means of welding and the like to the right and left ends of an upper frame component 22 at the upper end, a lower frame component 23 at the lower end, and three middle frame components 24 at three places in the middle. The front and rear surfaces of the structural frame body 2 are at the same plane and formed with a panel mounting surface 2*a*.

The side frame components 21 comprise three pipes of the same length having a square cross section, the side pipes 212 securely sandwiching the front and rear surfaces of the central pipe 211 so that the central pipe 211 is located inwardly of the side pipes 212 at the side end surface 1*a* of the frame. The upper frame component 22 forms the upper end surface 1*b,* and is composed of a central pipe 221, to the front and rear surfaces of which front and rear pipes 222 of a larger width than that of the central pipe 221 are fixed. The lower frame component 23 forms the lower end surface 1*c,* and is composed of a central pipe 231, to the front and rear surfaces of which front and rear pipes 232 of a larger width than that of the central pipe 231 are fixed. The three middle frame components 24 are composed of a central pipe 241, to the front and rear surfaces of which front and rear pipes 242 of a larger width than that of the central pipe 241 are fixed, and partition the wiring space 4 vertically.

Each of the front and rear panels 3 comprises three vertically arranged rectangular plates, and is attached to the panel mounting surface 2*a* of the structural frame body 2. A lid plate 31 is attached to the upper end surface 1*b* in order to arrange the appearance.

The wiring space 4 is a space closed by the side frame components 21, the upper frame component 22, the lower frame component 23, and the middle frame components 24 which form the structural frame body 2, and the panels 3. The wiring space 4 is opened by removing the panels 3.

In the movable partition wall 1 of the above arrangement of this embodiment, recessed portions 21*a* are formed in two upper and lower places of the right and left side frame components 21 at the front and rear panel mounting surfaces 2*a,* thereby to form wiring holes 6 which make the wiring space 4 communicate with the side end surfaces 1*a*. The recessed portions 21*a* are formed by cutting a portion of the same shape off each of the front and rear side pipes 212 of the side frame components 21 at the same locations.

Recessed portions 23*a* are also formed in the lower frame component 23 at the front and rear panel mounting surfaces 2*a,* thereby to form wiring holes 7 which make the wiring space 4 communicate with the lower end surface 1*c*. The recessed portions 23*a* are formed in two right and left places by cutting a portion of the same shape off each of the front and rear side pipes 232 of the lower frame component 23 and the continuous front and rear surfaces of the central pipe 231 at the same locations.

Furthermore, recessed portions 24*a* are also formed in the lowest middle frame component 24 at the front and rear panel mounting surfaces 2*a,* thereby to form wiring holes 8 which communicate the upper and lower wiring spaces 4 partitioned by the middle frame component 24 so that the wiring holes 6 in the side end surfaces 1*a,* the wiring space 4, and the wiring hole 7 in the lower end surface 1*c* communicate with each other. The recessed portions 24*a* are formed in two right and left places by cutting a portion of the same shape off each of the front and rear side pipes 242 of the middle frame component 24 and the continuous front and rear surfaces of the central pipe 241 at the same locations.

Figure 5:
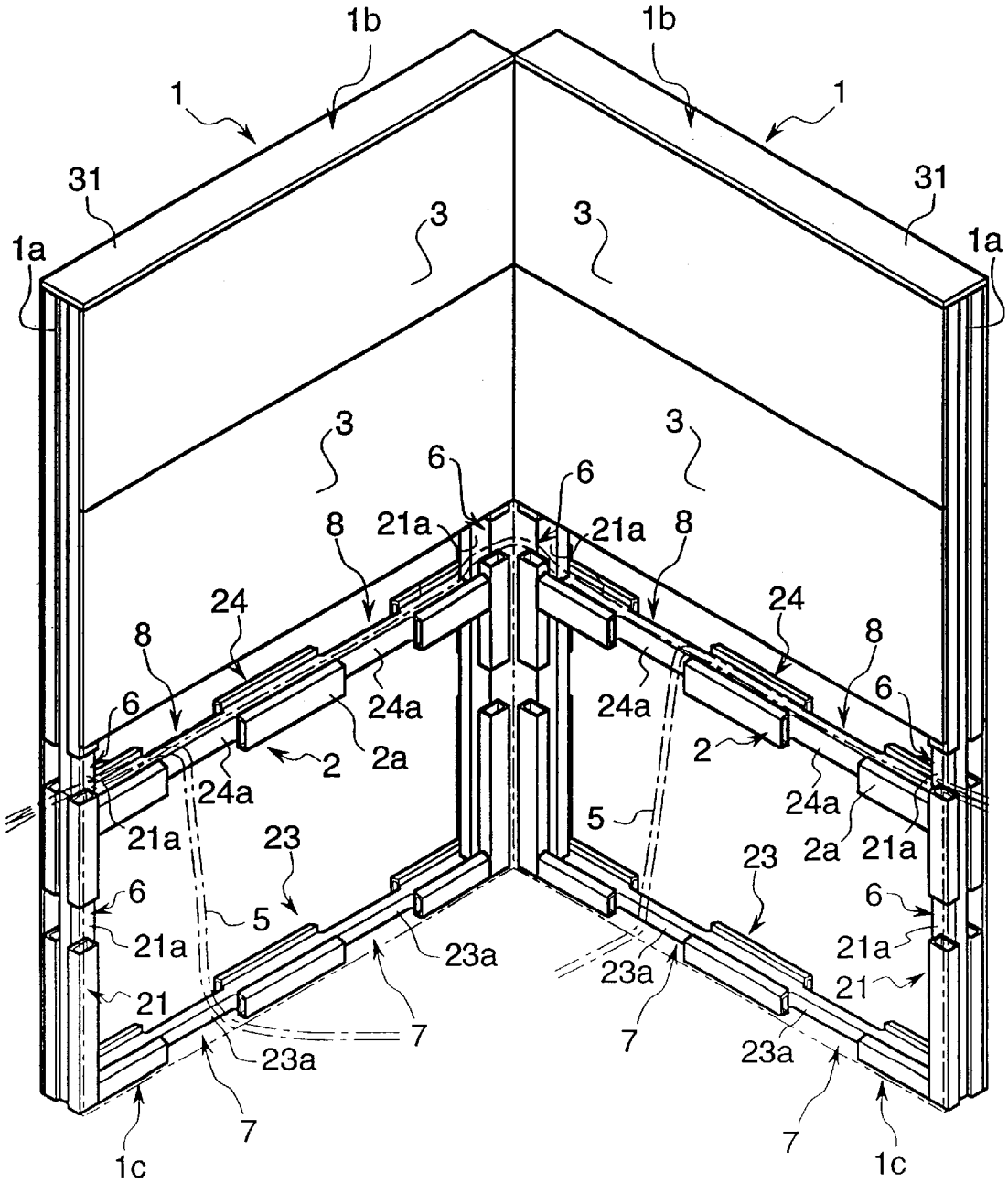
FIG. 5 is a perspective view showing an embodiment in which two panels are arranged side by side, and part of the panels is removed.

In the movable partition wall 1 of this arrangement, to store the cords 5 in the wiring space 4, as shown in FIG. 5, the panel 3 is removed from the panel mounting surface 2*a* to cause the cords 5 to extend through the recessed portions 21*a,* 23*a* and 24*a* of the panel mounting surface 2*a,* and then the panel 3 is again mounted onto the panel mounting surface 2*a*. Therefore, it is not necessary to insert the cords 5 from their tip ends through the wiring holes 6, 7 and 8, so that it is possible to make wiring work easy and to do the wiring work regardless of the structure of the connecting components at the tip end of the cords 5. Since the dimension of the wiring holes 6, 7 and 8 may be determined with consideration given only to the diameter of the cords 5, the dimension of the wiring holes 6, 7 and 8 can be reduced to a minimum essential, and many cords 5 can be easily passed through the wiring holes 6, 7 and 8. Furthermore, it is possible to keep connection of the cords 5 to the appliance during the wiring work.

Figure 6:
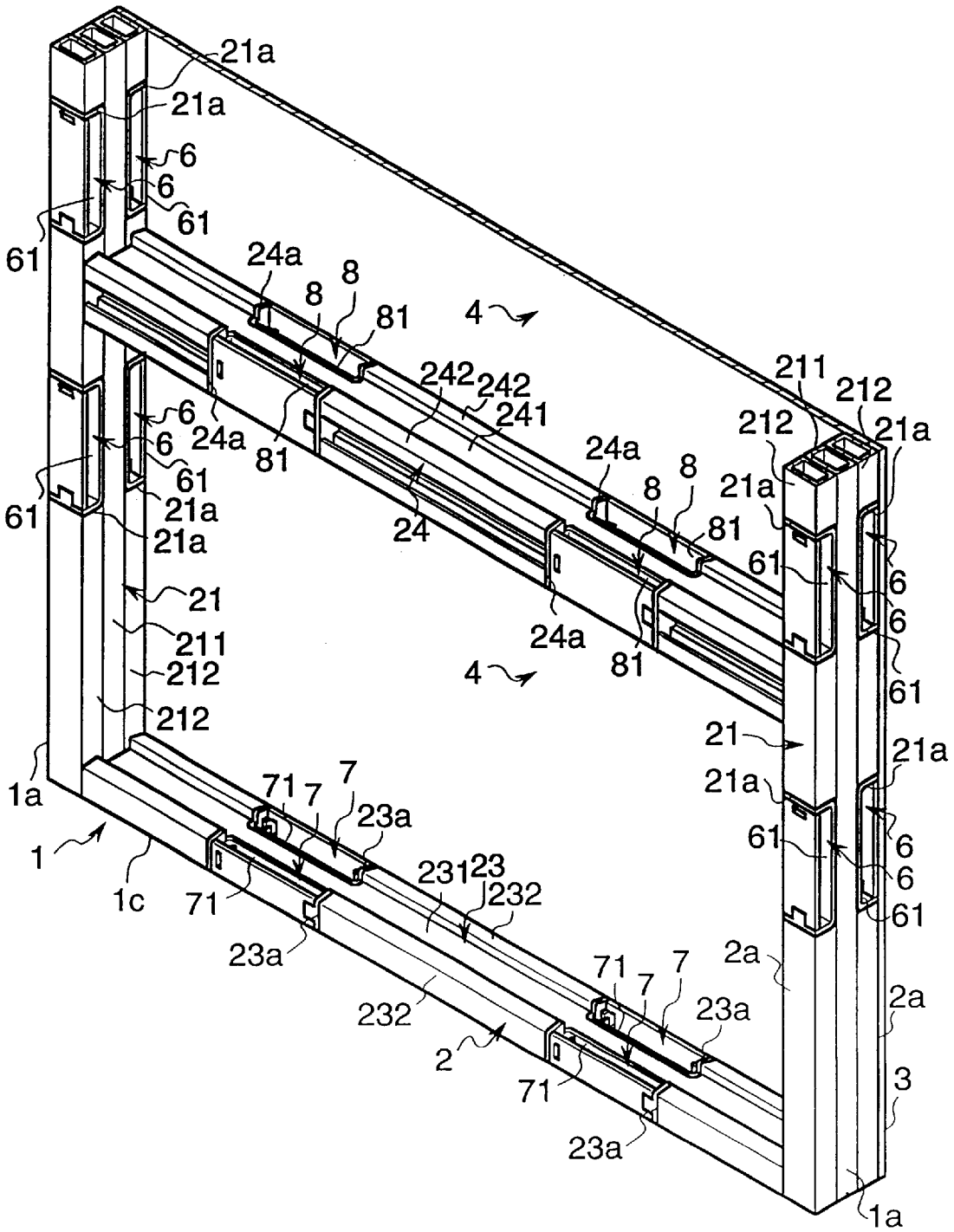
FIG. 6 is a perspective cross-sectional view showing an essential part of another embodiment.

In another embodiment shown in FIG. 6, caps 61, 71 and 81 made of resin are fitted in the recessed portions 21*a*, 23*a* and 24*a* to cover them.

Figure 7:
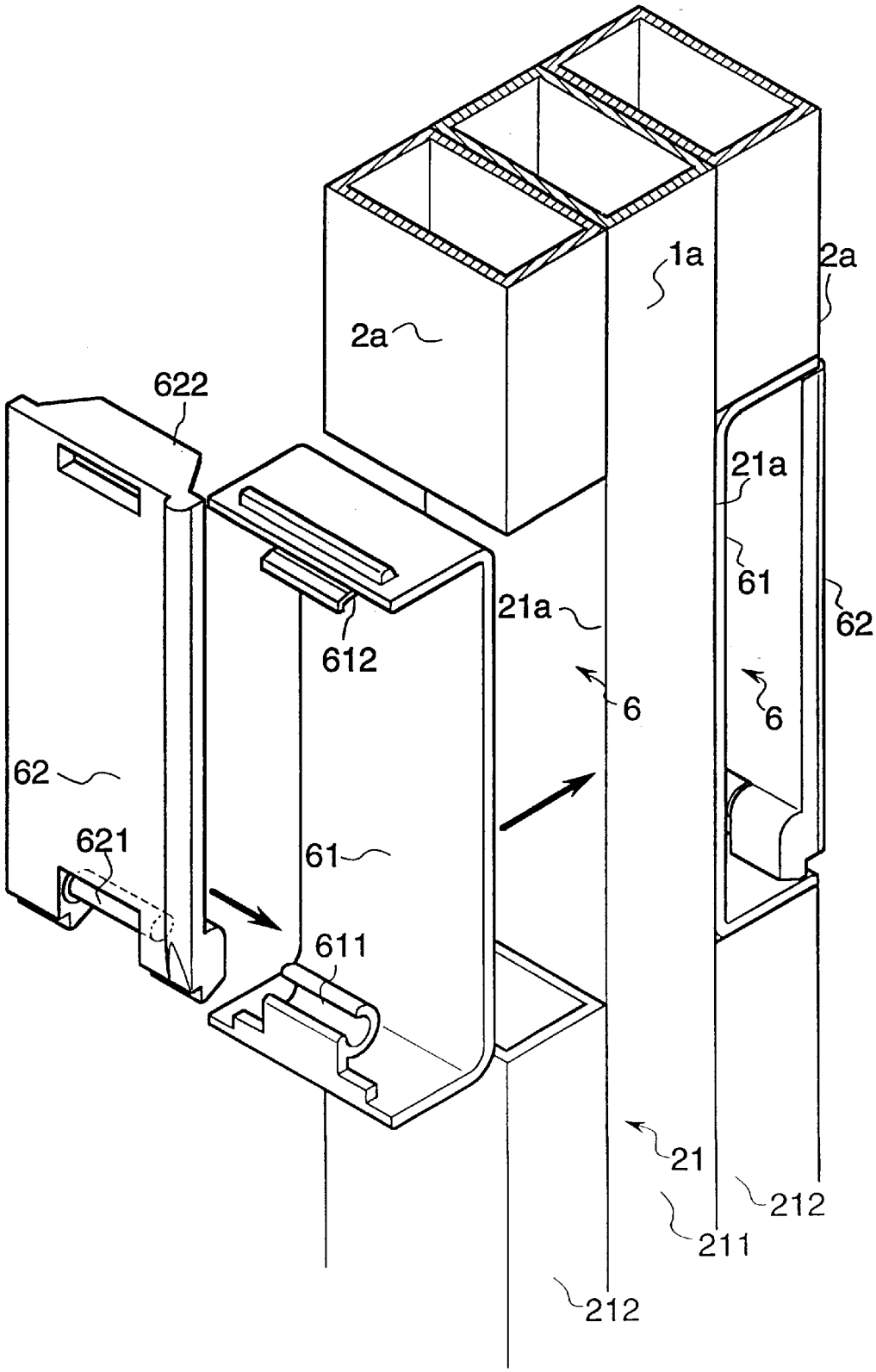
FIG. 7 is a partly broken, perspective cross-sectional view showing the wiring hole in the side frame component of the embodiment.

As shown in FIG. 7, the cap 61 is channel-shaped and attached to the upper, lower, and upright surfaces of the recessed portion 21*a*. The cap 61 is elastically transformed into the recessed portion 21*a*. A cover 62 is removably attached to the cap 61 so that the cover 62 and the panel mounting surface 2*a* are approximately at the same plane. The cover 62 is like a flat plate, and is formed near the lower end thereof with a pivot 621 adapted to engage in a bearing 611 formed on the cap 61 so that the cover 62 may be turned on the pivot 621 as far as the tip of an engaging craw 622 formed at the upper end of the cover 62 engages a not-illustrated projection of an engaging craw 612 formed on the cap 61. With the cap 61 and the cover 62 attached in the above manner, a space between the cap 61 and the cover 62 functions as the wiring hole 6.

Figure 8:
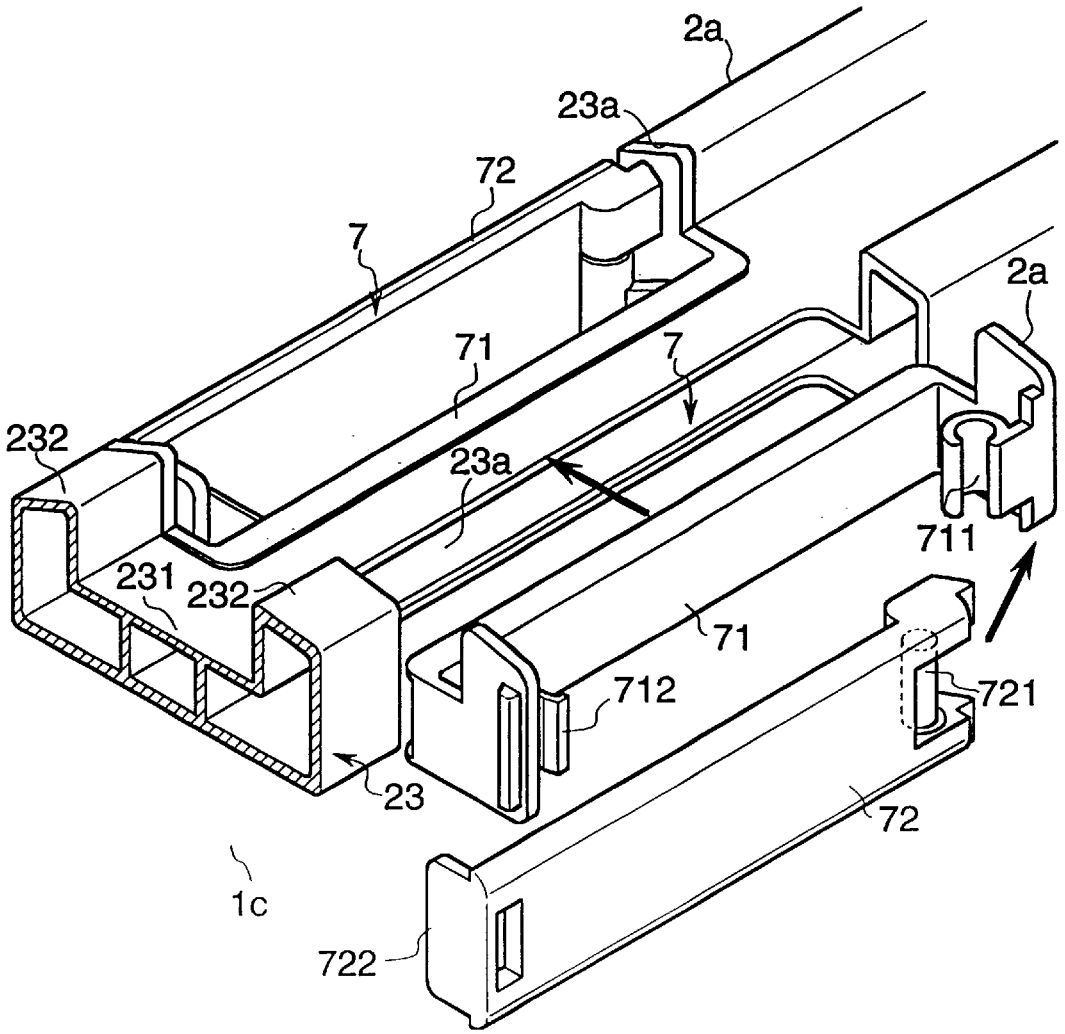
FIG. 8 is a partly broken, perspective cross-sectional view showing the wiring hole in the lower frame component of the embodiment.

As shown in FIG. 8, the cap 71 is channel-shaped and attached to the right side, left side, and upright surfaces of the recessed portion 23*a*. The cap 71 is elastically transformed into the recessed portion 23*a*. A cover 72 is removably attached to the cap 71 so that the cover 72 and the panel mounting surface 2*a* are approximately at the same plane. The cover 72 is like a flat plate, and is formed near the side end thereof with a pivot 721 adapted to engage in a bearing 711 formed on the cap 71 so that the cover 72 may be turned on the pivot 721 as far as the tip of an engaging craw 722 formed at the other side end of the cover 72 engages a not-illustrated projection of an engaging craw 712 formed on the cap 71. With the cap 71 and the cover 72 attached in the above manner, a space between the cap 71 and the cover 72 functions as the wiring hole 7.

Figure 9:
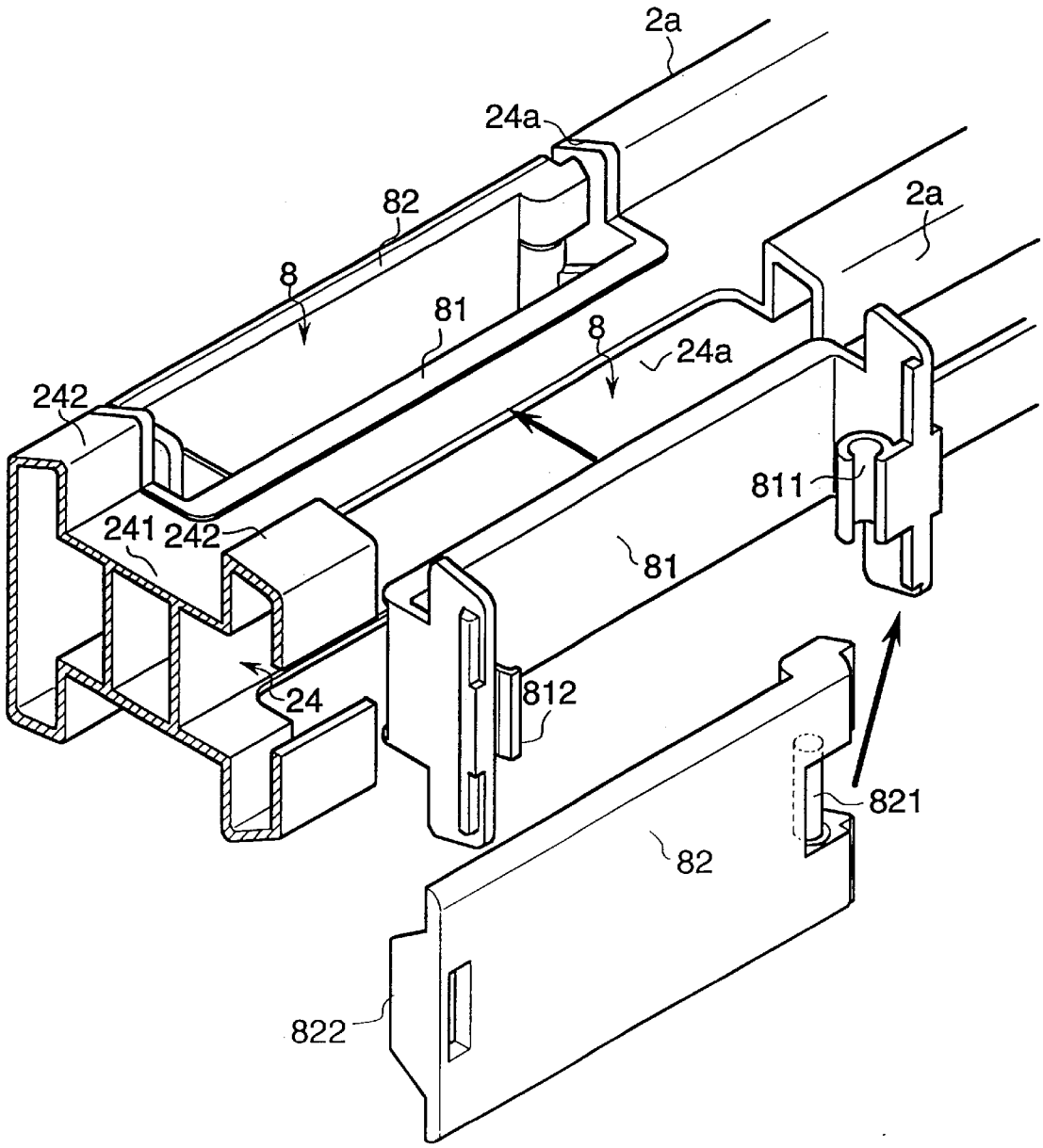
FIG. 9 is a partly broken, perspective cross-sectional view showing the wiring hole in the middle frame component of the embodiment.

As shown in FIG. 9, the cap 81 is channel-shaped and attached to the right side, left side, and upright surfaces of the recessed portion 24*a*. The cap 81 is elastically transformed into the recessed portion 24*a*. A cover 82 is removably attached to the cap 81 so that the cover 82 and the panel mounting surface 2*a* are approximately at the same plane. The cover 82 is like a flat plate, and is formed near the side end thereof with a pivot 821 adapted to engage in a bearing 811 formed on the cap 81 so that the cover 82 may be turned on the pivot 821 as far as the tip of an engaging craw 822 formed at the other side end of the cover 82 engages a not-illustrated projection of an engaging craw 812 formed on the cap 81. With the cap 81 and the cover 82 attached in the above manner, a space between the cap 81 and the cover 82 functions as the wiring hole 8.

Figure 10:
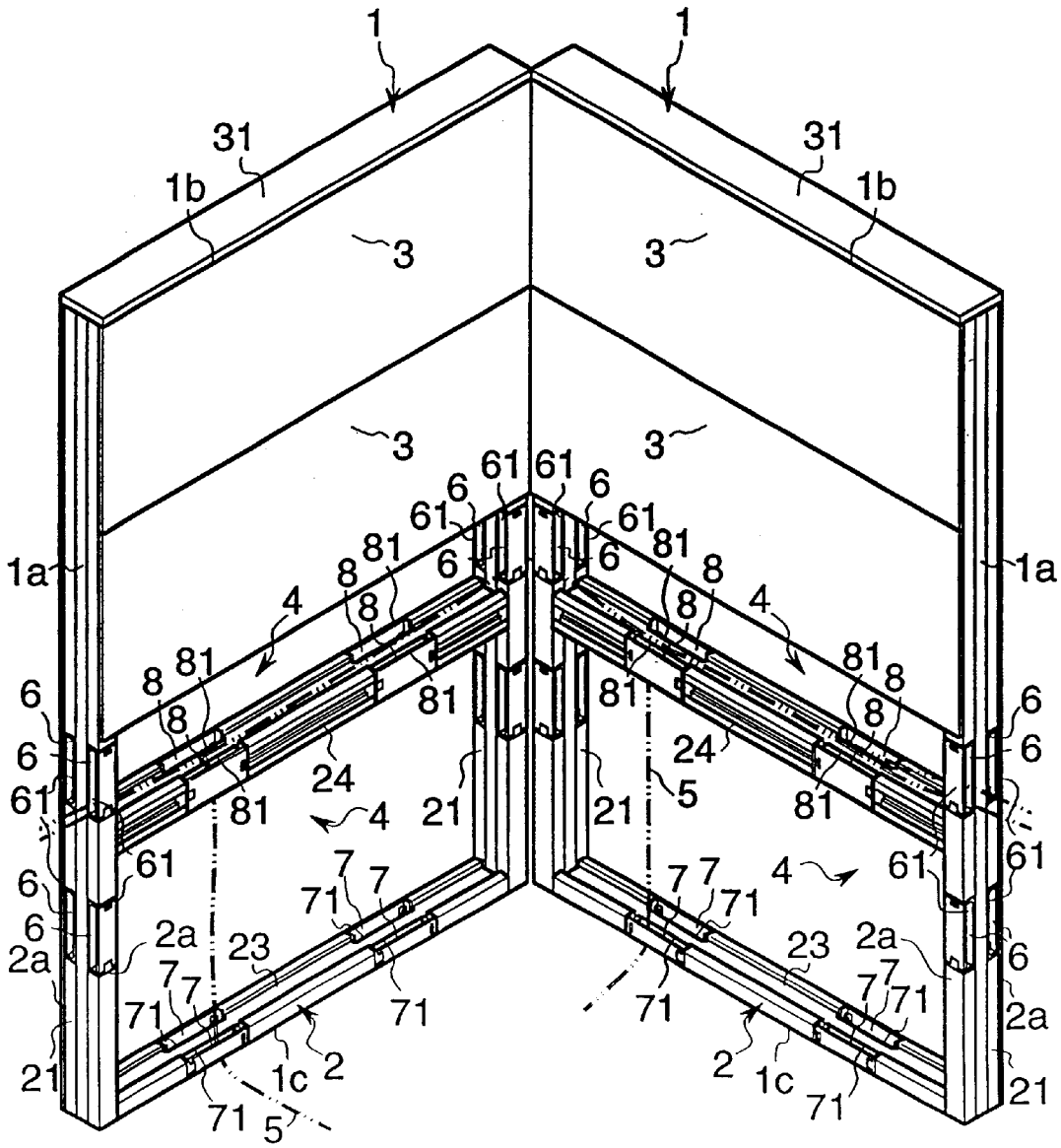
FIG. 10 is a perspective view showing an embodiment in which two panels are arranged side by side, and part of the panels is removed.
Figure 11:
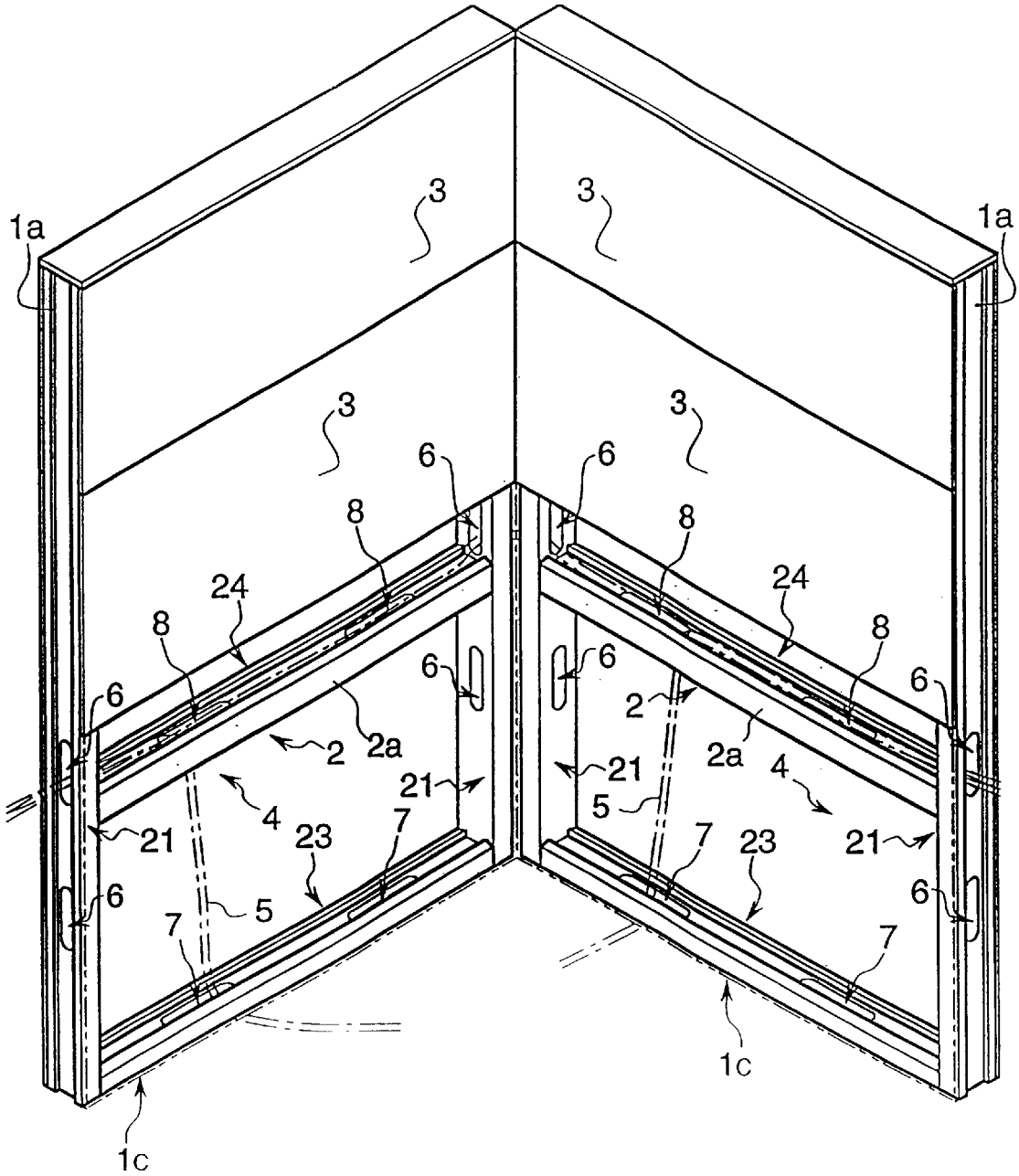
Fig. 11 PRIOR ART
FIG. 11 is a perspective view showing a conventional device, in which part of the panels is removed.

With this movable partition wall 1, wiring work to store the cords 5 in the wiring space 4 shown in FIG. 10 is executed by removing the lowest panel 3 from the panel mounting surface 2*a*, opening the covers 62, 72 and 82 of the caps 61, 71 and 81 attached to the recessed portions 21*a*, 23*a* and 24*a* in the panel mounting surface 2*a*, putting the cords 5 in the corresponding caps 61, 71 and 81, closing the covers 62, 72 and 82 to keep the cords 5 in the wiring holes 6, 7 and 8 formed between the caps 61, 71 and 81 and the covers 62, 72 and 82, and then mounting the panel 3 again to the panel mounting surface 2*a*. The covers 62, 72 and 82 may be removed from the caps 61, 71 and 81 if the covers 62, 72 and 82 are not necessary. In this case, the effective dimension of the wiring holes 6, 7 and 8 becomes larger, so that it becomes possible to put more or wider cords 5 in the wiring holes 6, 7 and 8.

It is needless to say that arrangements of this invention are not restricted to those described above. For example, it is possible to form a recessed portion in the upper end surface. The location, number, size, shape and the like of the wiring holes are arbitrary. For instance, it is possible to form the wiring hole only in one of the front and rear panel mounting surfaces. It is also possible to form the panel mounting surface only at the front side of the structural frame body. The invention does not eliminate the arrangements without the covers or with the covers which are not removable from the caps but are only opened and closed. Furthermore, various changes of the number, material, shape and the like of the components are possible in the range which does not deviate from the spirit of the invention.

POSSIBILITY OF USE IN INDUSTRY

As described above, the movable partition wall in accordance with the invention is effectively used as a low partition wall in an office room and the like.

I claim:

1. A movable partition wall comprising a structural frame body having front and rear sides and a panel mounting surface formed at least the front side thereof; a panel removably attached to the panel mounting surface of the structural frame body; a wiring space formed within the movable partition wall; a recessed portion in the panel mounting surface; and a wiring hole formed by the recessed portion and the panel so that the wiring space is capable of communicating with an outside of the structural frame body.

2. A movable partition wall as described in claim 1, wherein said recessed portion is formed in a side frame component which forms a side end surface of the structural frame body, said recessed portion of said side frame component forming the wiring hole so that said side end surface communicates with said wiring space.

3. A movable partition wall as described in claim 1, wherein said recessed portion is formed in an upper frame component which forms an upper end surface of the structural frame body, said recessed portion of said upper frame component forming the wiring hole so that said upper end surface communicates with said wiring space.

4. A movable partition wall as described in claim 1, wherein said recessed portion is formed in a lower frame component which forms a lower end surface of the structural frame body, said recessed portion of said lower frame component forming the wiring hole so that said lower end surface communicates with said wiring space.

5. A movable partition wall as described in claim 1, wherein said recessed portion is formed in a middle frame component provided horizontally in the wiring space to connect right and left side frame components and to partition the wiring space, said recessed portion forming the wiring hole so that the wiring space above the middle frame component communicates with the wiring space below the middle frame component.

6. A movable partition wall as described in claim 1, wherein a surface of said recessed portion is covered by a cap, and said wiring hole is formed by said cap and said panel.

7. A movable partition wall as described in claim 6, wherein a cover is removably fixed to the cap so that the cover is kept at approximately the same plane as said panel mounting surface, thereby forming said wiring hole between the cover and the cap.

8. A movable partition wall as described in claim 2, further comprising a recessed portion in the panel mounting surface of an upper frame component which forms an upper end surface of the structural frame body, said recessed portion of said upper frame component forming a wiring hole so that said upper end surface communicates with said wiring space.

9. A movable partition wall as described in claim 2, further comprising a recessed portion in the panel mounting surface of a lower frame component which forms a lower end surface of the structural frame body, said recessed portion of said lower frame component forming a wiring hole so that said lower end surface communicates with said wiring space.

10. A movable partition wall as described in claim 3, further comprising a recessed portion in the panel mounting surface of a lower frame component which forms a lower end surface of the structural frame body, said recessed portion of said lower frame component forming a wiring hole so that said lower end surface communicates with said wiring space.

11. A movable partition wall as described in claim 2, further comprising a recessed portion in the panel mounting surface of a middle frame component provided horizontally in the wiring space to connect the side frame component with an additional side frame component and to partition the wiring space, said recessed portion of said middle frame component forming a wiring hole so that the wiring space above the middle frame component communicates with the wiring space below the middle frame component.

12. A movable partition wall as described in claim 3, further comprising a recessed portion in the panel mounting surface of a middle frame component provided horizontally in the wiring space to connect right and left side frame components and to partition the wiring space, said recessed portion of said middle frame component forming a wiring hole so that the wiring space above the middle frame component communicates with the wiring space below the middle frame component.

13. A movable partition wall as described in claim 4, further comprising a recessed portion in the panel mounting surface of a middle frame component provided horizontally in the wiring space to connect right and left side frame components and to partition the wiring space, said recessed portion of said middle frame component forming a wiring hole so that the wiring space above the middle frame component communicates with the wiring space below the middle frame component.

14. A movable partition wall as described in claim 2, wherein a surface of said recessed portion is covered by a cap, and said wiring hole is formed by said cap and said panel.

15. A movable partition wall as described in claim 3, wherein a surface of said recessed portion is covered by a cap, and said wiring hole is formed by said cap and said panel.

16. A movable partition wall as described in claim 4, wherein a surface of said recessed portion is covered by a cap, and said wiring hole is formed by said cap and said panel.

17. A movable partition wall as described in claim 5, wherein a surface of said recessed portion is covered by a cap, and said wiring hole is formed by said cap and said panel.

18. A movable partition wall as described in claim 14, wherein a cover is removably fixed to the cap so that the cover is kept at approximately the same plane as said panel mounting surface, thereby forming said wiring hole between the cover and the cap.

19. A movable partition wall as described in claim 15, wherein a cover is removably fixed to the cap so that the cover is kept at approximately the same plane as said panel mounting surface, thereby forming said wiring hole between the cover and the cap.

20. A movable partition wall as described in claim 16, wherein a cover is removably fixed to the cap so that the cover is kept at approximately the same plane as said panel mounting surface, thereby forming said wiring hole between the cover and the cap.

21. A movable partition wall as described in claim 1 wherein an additional panel mounting surface is formed at the rear side of the structural frame body.

* * * * *

UNITED STATES PATENT AND TRADEMARK OFFICE

CERTIFICATE OF CORRECTION

PATENT NO.: 6,023,893

DATED: February 15, 2000

INVENTOR: Shigekazu TANAKA

It is certified that an error appears in the above-identified patent and that said Letters Patent is hereby corrected as shown below:

In Claim 1, column 6, line 30, immediately after the word "at", the word --at-- has been inserted.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*